US009178297B2

(12) United States Patent
Kodaira et al.

(10) Patent No.: US 9,178,297 B2
(45) Date of Patent: Nov. 3, 2015

(54) FLAT CABLE CONNECTOR

(71) Applicant: Tyco Electronics Japan G.K., Kanagawa-ken (JP)

(72) Inventors: Yoshihiko Kodaira, Kanagawa-ken (JP); Akira Kubo, Kanagawa-ken (JP); Hiroaki Kikuchi, Kanagawa-ken (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 26 days.

(21) Appl. No.: 14/068,550

(22) Filed: Oct. 31, 2013

(65) Prior Publication Data

US 2014/0120788 A1 May 1, 2014

(30) Foreign Application Priority Data

Oct. 31, 2012 (JP) ..... 2012-240830

(51) Int. Cl.

| | |
|---|---|
| ***H01R 12/24*** | (2006.01) |
| ***H01R 12/77*** | (2011.01) |
| ***H01R 13/627*** | (2006.01) |
| *H01R 12/79* | (2011.01) |

(52) U.S. Cl.

CPC ..... *H01R 12/774* (2013.01); *H01R 12/771* (2013.01); *H01R 13/6275* (2013.01); *H01R 12/79* (2013.01)

(58) Field of Classification Search

CPC ... H01R 12/79; H01R 12/771; H01R 13/6275
USPC ..... 439/892, 329, 492–494, 499, 495
See application file for complete search history.

(56) References Cited

U.S. PATENT DOCUMENTS

| | | | | |
|---|---|---|---|---|
| 3,149,896 | A * | 9/1964 | Hall | 439/329 |
| 4,639,063 | A * | 1/1987 | Mueller | 439/325 |
| 4,944,690 | A * | 7/1990 | Imai | 439/492 |
| 4,948,378 | A * | 8/1990 | Hoshino | 439/271 |
| 5,356,308 | A * | 10/1994 | Toba et al. | 439/495 |
| 6,074,220 | A * | 6/2000 | Roberts | 439/67 |
| 6,250,953 | B1 * | 6/2001 | Niitsu | 439/497 |
| 6,361,358 | B1 | 3/2002 | Kajinuma | |
| 7,708,588 | B2 * | 5/2010 | Chen | 439/492 |
| 2010/0075529 | A1 * | 3/2010 | Niitsu | 439/377 |
| 2010/0255705 | A1 * | 10/2010 | Higuchi | 439/329 |
| 2011/0306229 | A1 * | 12/2011 | Katsui et al. | 439/345 |

FOREIGN PATENT DOCUMENTS

| | | |
|---|---|---|
| JP | 660081 | 8/1994 |
| JP | 2622528 | 4/1997 |
| JP | 09161863 | 6/1997 |
| JP | 09035826 | 7/1997 |

* cited by examiner

*Primary Examiner* — Neil Abrams
*Assistant Examiner* — Travis Chambers
(74) *Attorney, Agent, or Firm* — Barley Snyder

(57) ABSTRACT

A flat cable connector is provides that includes a housing, a contact, and a cover member. The housing includes a top surface, a side surface adjacent the top surface, and a lock section disposed along the side surface. The contact is received in the housing and includes a portion protruding from the top surface. The cover member includes a planar surface and a lock extending from the planar surface and engageable with the lock section.

16 Claims, 7 Drawing Sheets

FLAT CABLE CONNECTOR

CROSS-REFERENCE TO RELATED APPLICATIONS

This application claims the benefit of the filing date under 35 U.S.C. §119(a)-(d) of Japanese Patent Application No. 2012-240830, filed Oct. 31, 2012.

FIELD OF INVENTION

The present invention relates to a cable connector and, more particularly, to a flat cable connector.

BACKGROUND

A flat cable connector for connecting a flat cable represented by Flexible Flat Cable (FFC) or Flexible Printed Circuit (FPC) to a circuit board is generally known. For example, Japanese Utility Model Publication H6-60081A discloses an electrical connector for connecting a FPC. A reinforcement metal plate is attached at a tip of the FPC that connects to the electrical connector. A pair of metal securing members are provided in the electrical connector secure the FPC. The metal securing members extend upwards at areas corresponding to both sides of the FPC. When the FPC is pushed into an area between the pair of metal securing members, the metal securing members are pushed away by the FPC and the reinforcement plate to be deformed. When the FPC is completely pushed in, the metal securing members recover from being deformed to lock to a top surface of the reinforcement plate.

In addition, Japanese Patent Publication H9-161863A discloses an electrical connector in which contacts protrude from side surfaces of a housing. Upon connecting a FPC, when a cover member having a frame shape according to an appearance of the housing is pressed on the FPC that is put on the housing, the FPC is bent along a shape of the housing. The FPC is bent approximately perpendicularly along the side surface at a position thereof corresponding to the side surface of the housing to make contact with a contact.

Since the electrical connector of Japanese Utility Model Publication H6-60081A has a configuration in which the metal securing member locks to the top surface of the reinforcement plate attached to the FPC, the electrical connector is made high profile. In addition, in the electrical connector of Japanese Patent Publication H9-161863A, the cover member is pressed and the FPC is bent to make a connection, a large operation force is required and the operation of the connector is not easy. In addition, since the FPC is bent, the reliability may be decreased.

SUMMARY

In view of the foregoing problems, the invention has been made to provide a flat cable connector whose connection operation is easy and is also made low profile.

The flat cable connector includes a housing, a contact, and a cover member. The housing includes a top surface, a side surface adjacent the top surface, and a lock section disposed along the side surface. The contact is received in the housing and includes a portion protruding from the top surface. The cover member includes a planar surface and a lock extending from the planar surface and engageable with the lock section.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EMBODIMENT(S)

An embodiment of a flat cable connector 1 according to the invention will be described with reference to the attached drawings in the followings.

Figure 1:
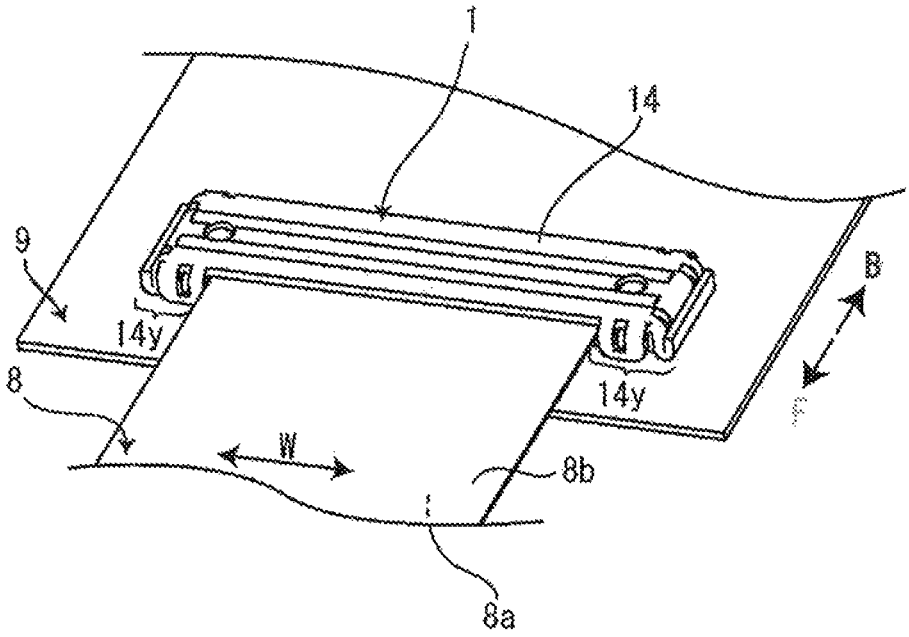
FIG. 1 is a perspective view illustrating a flat cable connector according to the invention.

With reference to FIG. 1, the flat cable connector 1 (hereafter, simply referred to as connector 1) according to the present invention is shown, which is a connector to electrically connect a FPC 8 to a circuit board 9.

The FPC 18 is a cable having flexibility and a ribbon-like shape. The FPC 8 has, for example, a configuration in which conductor patterns are provided on a surface of a film made of resin. As a configuration of the FPC 8, a configuration in which plural sets of a film made of resin and conductor patterns are laminated may also be used.

An end portion of the FPC 8 is connected to the connector 1 according to the embodiment.

Terminal patterns 81 (see FIG. 4) are provided on a terminal surface 8*a* which is a bottom surface opposite to a top surface 8*b* shown in FIG. 1 of the FPC 8. The terminal patterns 81 (see FIG. 4) are end portions of electrically conductive patterns extending on the terminal surface 8*a*. However, if the FPC has a configuration in which plural sets of a film made of resin and conductor patterns are laminated, the terminal patterns 81 (see FIG. 4) may be conductors which are connected via through holes to the conductor patterns sandwiched respectively between the plural films made of resin. Incidentally, the terminal patterns also may be provided on the top surface 8*b* opposite to the terminal surface 8*a*.

Now with reference to FIGS. 2-7, the connector 1 is shown that may include a housing 11, contacts 12 and a cover member 14. Incidentally, FIG. 2 also shows the FPC 8. The end portion of the FPC 8 is sandwiched between the cover member 14 and the housing 11.

In an exemplary embodiment, the housing 11 has an approximately rectangular and tabular and is formed by electrically insulating resin material. The housing 11 is arranged in a state in which the bottom surface 11*a* is opposed to the circuit board 9 (see FIG. 1). The top surface 11*b* of the housing 11 is opposed to the terminal surface 8*a* of the FPC 8 on which the terminal patterns 81 are formed.

Figure 2:
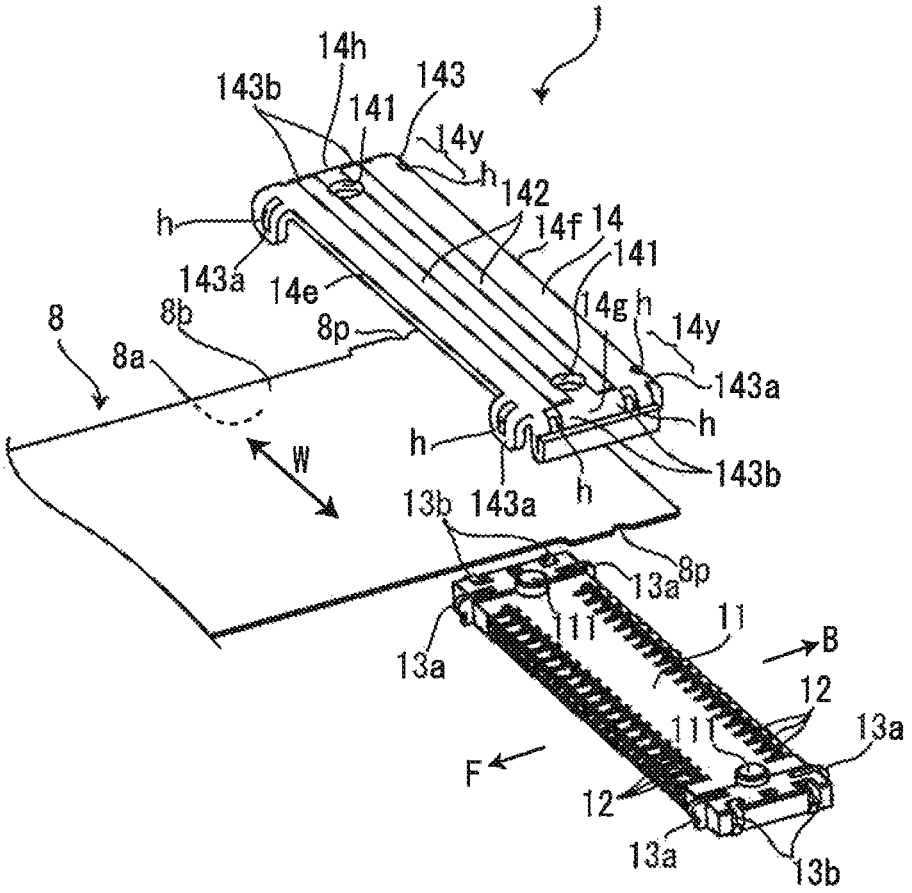
FIG. 2 is an exploded perspective view of the flat cable connector of FIG. 1.
Figure 3:
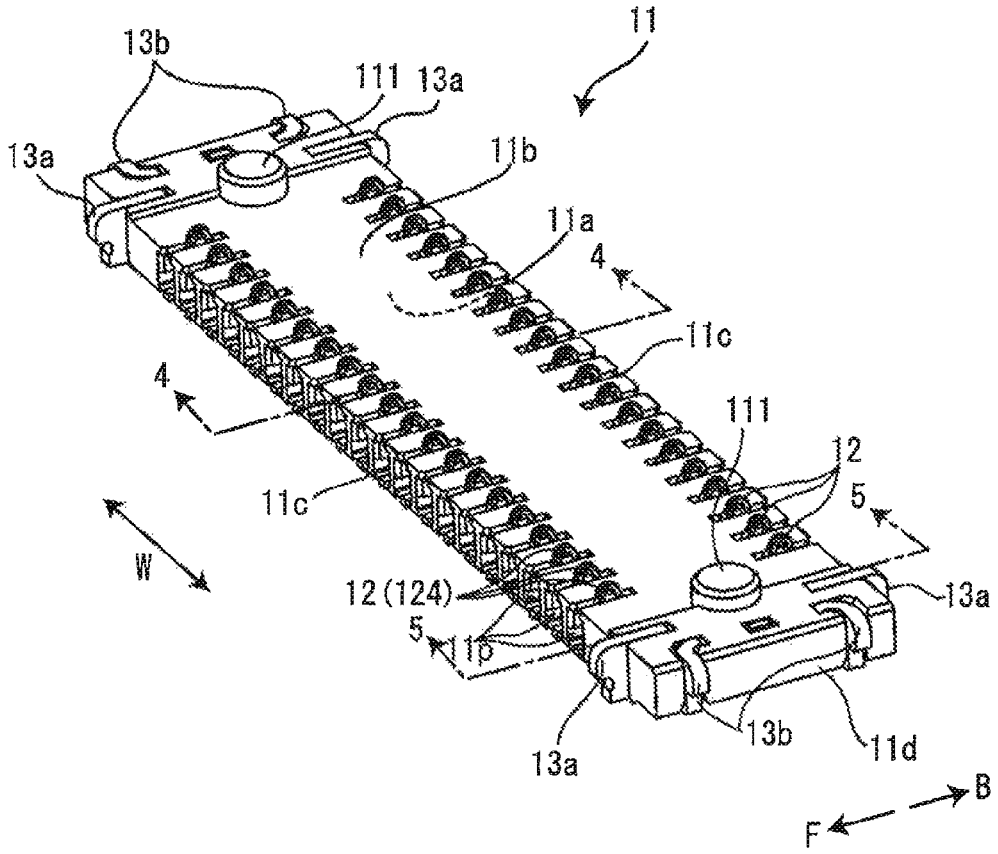
FIG. 3 is an enlarged perspective view of a housing of the flat cable connector of FIG. 2.

In an exemplary embodiment, a pair of positioning protrusions 111 are provided on the top surface 11*b* of the housing 11. Each of the pair of positioning protrusions 111 is arranged with a space therebetween corresponding to a width of the FPC 8. In contrast, As shown in FIG. 2, notches 8*p* into which the positioning protrusions 111 enter are provided on both side edges in a width W of the FPC 8.

The positioning protrusions 111 of the housing 11 enter the notches 8*p* when the FPC 8 is put on the top surface 11*b* of the housing 11, thereby positioning the FPC 8 with respect to the housing 11.

In an exemplary embodiment, contact receiving grooves 11*p* are provided in side surfaces 11*c* along a width W of the housing 11. Contacts 12 are accommodated in the contact receiving grooves 11P. The contacts 12 are arranged in two rows. Each of the rows of the contacts 12 extends along the width W.

In an exemplary embodiment, the contacts 12 are formed by stamping and forming an electrically conductive metal plate. Each of the contacts 12 includes a board connection section 121, a press-fit section 122, an elastically deforming section 123 and a contact section 124. The board connection sections 121 are exposed on the bottom surface 11*a* of the housing 11. The board connection sections 121 are connected by solder to an electrically conductive pattern (not illustrated) of the circuit board 9 (see FIG. 1), respectively. Each of the press-fit sections 122 is a portion to be press-fit into each of the contact receiving grooves 11*p* of the housing 11. The board connection sections 121 of the contacts 12, press-fit into the housing 11, are connected by solder to the circuit board 8 (see FIG. 1), so that the housing 11 is indirectly secured to the circuit board 9 (see FIG. 1). The elastically deforming sections 123 are provided between the press-fit sections 122 and the contact sections 124, and are deformed according to external forces received by the contact sections 124, respectively. The contact sections 124 are portions to make contact with the terminal patterns 81 of the FPC 8, respectively. The contacts 12 are accommodated in the housing 11 in a state in which the contact sections 124 protrude from the top surface 11*b* of the housing 11, respectively.

In an exemplary embodiment, the housing 11 includes eight lock sections 13*a*, 13*b*. The eight lock sections 13*a*, 13*b* are arranged on side surfaces 11*c*, 11*d* of the housing 11. More specifically, each of the eight lock sections 13*a*, 13*b* is a claw, and is formed by a conductive metal piece (peg) secured to the housing 11.

In an exemplary embodiment, four first lock sections 13*a* out of the eight lock sections 13*a*, 13*b* are arranged on an extension line from each of the two rows of the contacts 12. The first lock sections 13*a* are arranged on the side surfaces 11*c* extending in the width W of the housing 11, respectively. Each of the first lock sections 13*a* includes a board connection section 131, a press-fit section 132 and a lock claw section 133. The board connection section 131 is a portion to be connected by solder to the circuit board 9 (see FIG. 1). In addition, the press-fit sections 132 are portions to be press-fit to the housing 11. The lock claw sections 133 protrude in hook shapes from the side surfaces 11*c* of the housing 11 in directions approximately perpendicular to the width W of the housing 11. The lock sections 13*a* press-fit to the housing 11 are connected by solder to the circuit board 9 (see FIG. 1), so that the housing 11 is indirectly secured to the circuit board 9 (see FIG. 1).

In an exemplary embodiment, the remaining four second lock sections 13*b* out of the eight lock sections 13*a*, 13*b* are arranged on more outer sides in the width W than the first lock sections 13*a*. Each of the second lock sections 13*b* is a metal piece having a configuration similar to those of the first lock sections 13*a*. However, each of the second lock sections 13*b* has a shape of being curved halfway. The second lock sections 13*b* protrude in the width W from the side surfaces 11*d* of the housing 11, which side surfaces 11*d* extend in directions approximately perpendicular to the width W.

In an exemplary embodiment, the cover member 14 is a tabular member portions of whose edges are curved. As shown in FIG. 2, the cover member 14 has a rectangular shape longer than the width of the FPC 8. FIG. 2 also shows the cover member 14 being separated from the FPC 8. However, in a process in which the FPC 8 is connected to the connector 1, the cover member 14 is secured to the FPC 8 in advance. In addition, the housing 11 is secured to the circuit board 9 (see FIG. 1). Subsequently, the FPC 8 to which the cover member 14 is secured is connected to the housing 11.

The cover member 14 is secured to the top surface 8*b* which is the surface opposite to the terminal surface 8*a* of the FPC 8. More specifically, the cover member 14 is adhered to the FPC 8. The cover member 14 is adhered to the FPC 8 in which both side edge portions of the cover member 14 extend off from both sides of the FPC 8 along the width W. The portions of the cover member 14 extended off from the FPC 8 are referred to as extensions 14*y*.

In an exemplary embodiment, the cover member 14 is formed by stamping, pressurizing and forming an electrically conductive metal plate. The cover member 14 includes guide openings 141 which the positioning protrusions 111 of the housing 11 enter. The positioning protrusions 111 and the guide openings 141 guide movement during connected. In addition, the cover member 14 includes two ridges 142 which extend upward and along the width W. Since the cover member 14 is reinforced by the ridges 142, deformation of the cover member 14 is reduced.

In an exemplary embodiment, the cover member 14 includes first locks 143*a* provided at four positions and second locks 143*b* provided at four positions. The first locks 143*a* lock to the first lock sections 13*a* attached to the housing 11, and the second locks 143*b* lock to the second lock sections 13*b*. The locks 143*a*, 143*b* are portions turning from edges of the extensions 14*y* of the cover member 14 to extend toward the housing 11 (in other words, downward).

Two first locks 143*a* arranged on a side of the forward F out of the four first locks 143*a* extend downward from both end portions in an edge 14*e* in the forward F of the cover member 14, in other words, from edges on both sides in the width W of the extensions 14*y*. In addition, the first locks 143*a* extend downward from an edge 14*f*. The first locks 143*a* extend from the extensions 14*y* arranged at the two positions along the width W, and each of the first locks 143 is a one-piece protrusion piece continuing across all over the edge 14*f*. Each of the first locks 143*a* arranged at the four positions includes a lock opening h which the first lock section 13*a* enters.

The second locks 143*b* are portions turning from edges 14*g*, 14*h* on both sides along the width W of the cover member 14 and extending toward the housing 11 (in other words, downward). Two out of the four second locks 143*b* extend from the one edge 14*g*, and remaining two out of them extend from the other edge 14*h*. The second locks 143*b* extending from the above-described one edge 14*g* extend from two positions on sides along the edge 14*g*, and the second locks 143*b* of the shown embodiment are included in a one-piece protrusion piece continuing across all over the edge 14*g*. Regarding the other edge 14*h*, the second locks 143*b* extend from two positions on sides, and the second locks 143*b* are included in a one-piece protrusion piece continuing across all over the edge 14*h*. Each of the four second locks 143*b* includes a lock opening h which each of the second lock sections 13*b* secured to the housing 11 enters. Incidentally, a tip of each of the second locks 143*b* further turns back to extend upward. By turning back, strength against deformation is improved.

Figure 4:
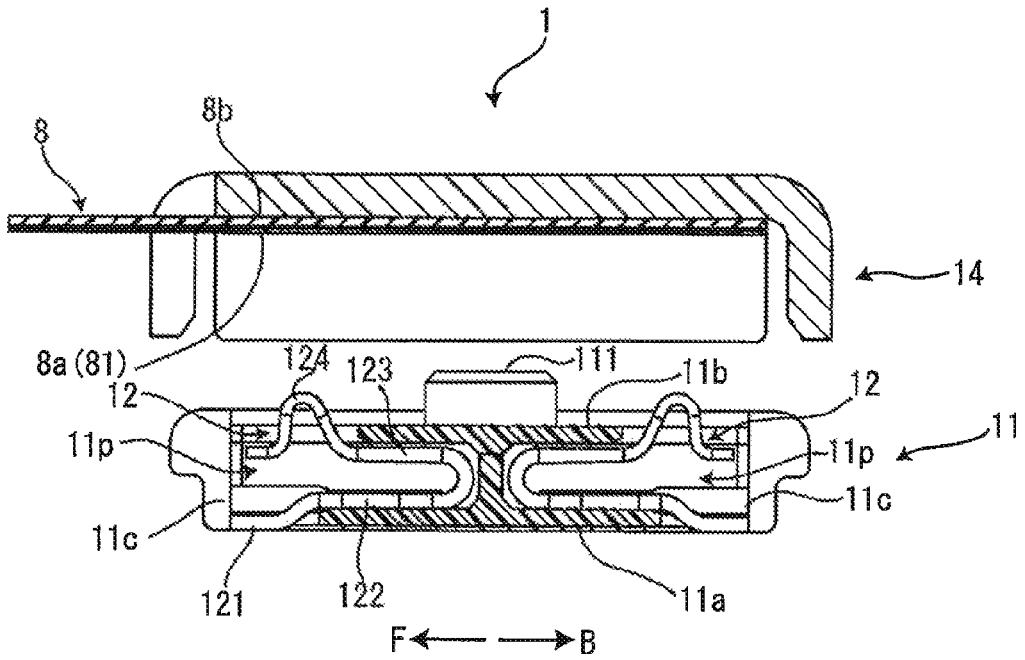
FIG. 4 is a cross sectional view of the housing of FIG. 3 along the line 4-4, shown together with a corresponding cross section of a cover member and an FPC.
Figure 5:
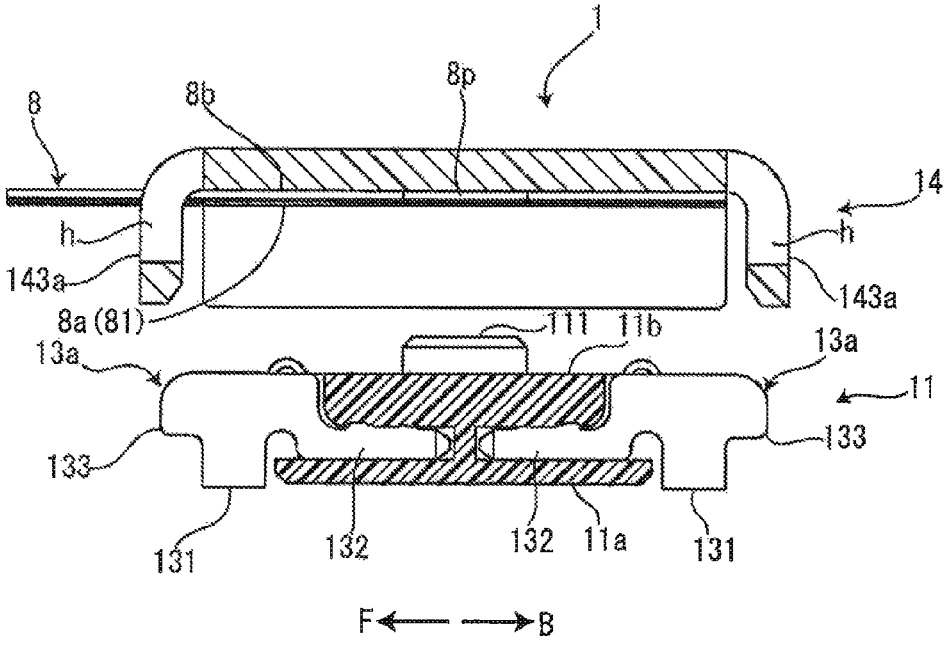
FIG. 5 is another cross sectional view of the housing illustrated in FIG. 3, along the line 4-4, shown together with a corresponding cross section of a cover member and an FPC.
Figure 6:
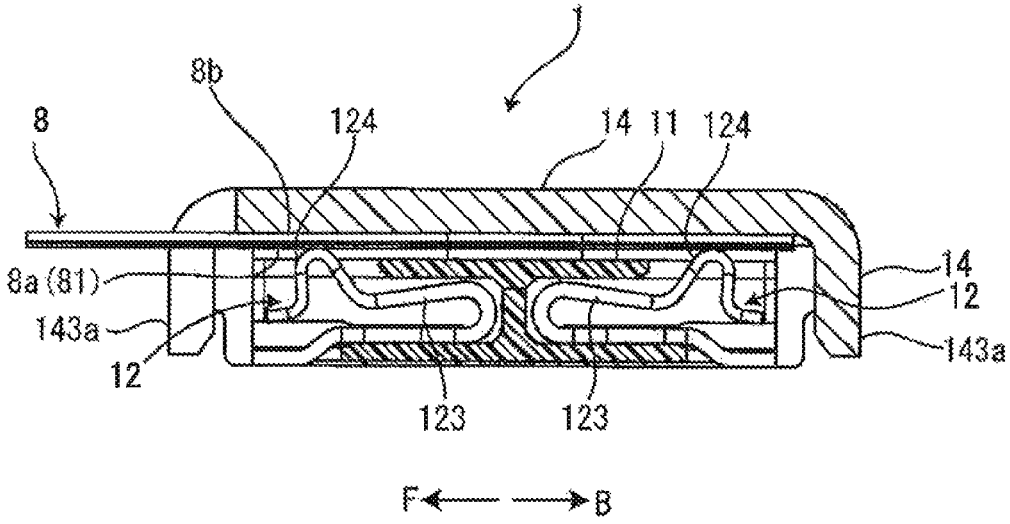
FIG. 6 is a cross sectional view of the housing of FIG. 3, showing the FPC connected to the connector.
Figure 7:
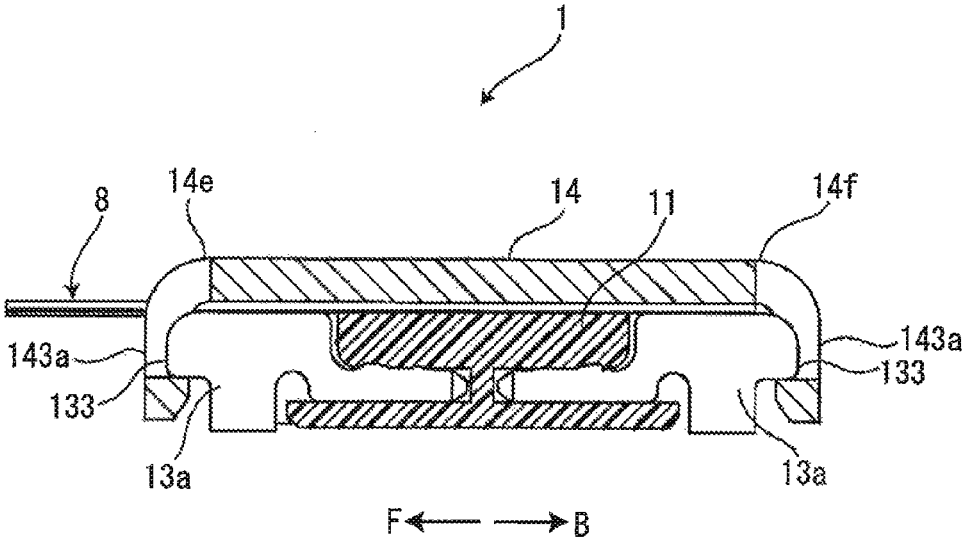
FIG. 7 is a cross sectional view of the housing of FIG. 4, showing the FPC connected to the connector.

As shown in FIGS. 4 and 5, when the FPC 8 to which the cover member 14 is adhered is moved downward toward the housing 11, the terminal patterns 81 of the FPC 8 make contact with the contact sections 124 of the contacts 12. When the FPC 8 is further pressed downward, the FPC 8 presses against the contacts 12, and the elastically deforming sections 123 of the contacts 12 are elastically deformed, as shown in FIG. 6. In addition, as shown in FIG. 7, the first locks 143*a* of the cover member 14 secure to the lock claws 133, which protrude from the side surfaces 11*c* (see FIG. 3) of the housing 11. In addition, the second lock 143*b* (see FIG. 2) of the contacts 12 secure to the second lock sections 13*b* (see FIG. 2) that are secured to the housing 11. Accordingly, the cover member 14 and the FPC 8 are prevented from being pulled out from the housing 11. In addition, as shown in FIG. 6, the contact sections 124 of the contacts 12 are pressed against the terminal patterns 81 of the FPC 8 by the elastic forces of the elastically deforming sections 123. Accordingly, a secure connection is retained. As a result, the contact sections 124 of the contacts 12 are electrically connected using the contacts 12 to the conductor patterns (not illustrated) of the circuit board 9 (see FIG. 1). In addition, the FPC 8 is covered by the cover member 14 made of the electrically conductive material. Since the cover member 14 functions as an electromagnetic shield, effects by electromagnetic radiation and exogenous noise are reduced.

Since four corners of the cover member 14 to which the FPC 8 is adhered lock to the housing 11 by the four first locks 143*a* and the four first lock sections 13*a*, the contacts 12 abut on the terminal patterns 81 of the FPC 8 by forces which are equivalent to each other, respectively. In addition, since the cover member 14 is further locked to the housing 11 by the second locks 143*b* and the second lock sections 13*b*, the cover member 14 is more securely prevented from being pulled out.

In addition, the locks 143*a*, 143*b* secure to the lock claws 133 of the lock sections 13*a*, 13*b*, respectively, and thus, the cover member 14 and the circuit board 9 (see FIG. 1) are electrically conductively connected to each other. For this reason, in the connector 1 of the shown embodiment, a dedicated member for electrically conductively connecting the cover member 14 and the circuit board 9 (see FIG. 1) is not required.

In the connector 1 of the shown embodiment, both of the first locks 143*a* and the second locks 143*b* extend from the edges of the cover member 14 over the FPC 8 toward the housing 11. Both of the first locks 143*a* and the second locks 143*b* secure to the side surfaces 11*c*, 11*d* of the housing 11. Accordingly, the lock configuration is arranged in a height same as those of the contacts 12, and does not exist over the FPC 8. Accordingly, the connector 1 is made low profile, compared to, for example, a configuration in which a lock configuration is provided over a cover member.

In addition, the connector 1 of the shown embodiment is connected without deforming the FPC 8 while maintaining the plate shape thereof. Thus, compared to a configuration in which an FPC is deformed when being connected, a force of connecting is reduced. Accordingly, the operation of the connecting is easy. In addition, since the FPC is not deformed, the reliability is improved.

In addition, the cover member 14 is adhered to the FPC 8 before the housing 11 is connected to the FPC 8. For this reason, at the time of connecting operation, it is not required to hold the FPC 8 and the cover member 14 independently. Accordingly, the operation of the connecting is made simple.

When the FPC 8 is removed in the shown embodiment, a jig is inserted between the first locks 143*a*, the second locks 143*b* and the housing 11 to release the locking. The removed FPC 8 is not bent and has the same shape as that before being attached. Accordingly, it is easy to remove the FPC 8 and make a connection again.

Incidentally, in the above-described embodiment, as an example of the lock according to the invention, the first locks 143*a* and the second locks 143*b* are described. However, the present invention is not limited to this. For example, either of the first locks or the second locks may be arranged. In addition, the respective number of them may be two or three or 5 and more.

In addition, in the shown embodiment, as an example of the locks according to the invention, the first locks 143*a* and the second locks 143*b* secure to the lock sections 13*a*, 13*b* which are made of metal and secured to the housing are described. However, the present invention is not limited to this. For example, a mating member to which the locks secure may be a protrusion which is integrally formed with a housing. In addition, in the shown embodiment, as an example of the locks according to the invention, the first locks 143*a* and the second locks 143*b* both having lock openings h are described. However, the present invention is not limited to this. The locks may have, for example, hooks which lock to concave sections provided in a housing.

In addition, in the above-described embodiment, as an example of the lock according to the present invention, the first locks 143*a* and the second locks 143*b* connected across all over the edges 14*f*, 14*g*, 14*h* of the cover member 14 are described. However, the invention is not limited to this. For example, the locks may be separated from each other, like the locks 143*a* extending from the edge 14*e* in the forward F. The connector 1 in the shown embodiment is connected to the end portion of the FPC 8, and however, for example, in a case of being connected to a midpoint of a ribbon-like-shaped FPC, the locks may extend from the backward edge also are separated from each other, like the ones in the forward.

In addition, in the above-described embodiment, the connector 1 to be connected to the FPC 8 is described. However, the present invention is not limited to this. What is connected to the connector may be, for example, an FFC.

In addition, in the above-described embodiment, as an example of the cover member, the cover member 14 made of the electrically conductive material is described. However, the invention is not limited this. For example, the cover member may be insulative.

In addition, in the above-described embodiment, as an example of the FPC, an FPC on whose bottom surface the terminal patterns 81 are arranged is described. However, the invention is not limited to this. For example, a ground pattern to make contact with a cover member or a conductor pattern for electrical power supply or signal may be arranged also on a top surface. In this case, the FPC 8 and the circuit board 9 may be electrically conducted via the cover member 14 and the lock sections (pegs) 13*a*, 13*b*.

Further, securing the FPC 8 and the cover member 14 to each other may be secured by mechanical means such as a crimping apparatus as well as fixing by an adhesive.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A flat cable connector, comprising:

a housing having a top surface, a side surface adjacent the top surface, and a lock section disposed along the side surface, and having a protruding claw;

a contact located in the housing and having a portion protruding from the top surface; and a cover member having a planar surface, a lock extending from the planar surface, having a claw receiving opening that vertically receives the protruding claw to snap-fit the housing to the cover member.

2. The flat cable connector according to claim 1, wherein the housing is tabular.

3. The flat cable connector according to claim 1, wherein the planar surface is tabular.

4. The flat cable connector according to claim 1, further comprising a pair of positioning protrusions disposed on the top surface of the housing.

5. The flat cable connector according to claim 1, wherein the cover member is formed of an electrically conductive material.

6. The flat cable connector according to claim 5, wherein the protruding claw is electrically conductive.

7. The flat cable connector according to claim 1, further comprising a second lock section positioned opposite the lock section.

8. The flat cable connector according to claim 7, further comprising a second lock positioned opposite the lock.

9. The flat cable connector according to claim 1, wherein the lock section includes a claw having a conductive metal piece secured to the housing.

10. The flat cable connector according to claim 9, wherein the lock section includes a board connection section, a press-fit section, and a lock claw section.

11. The flat cable connector according to claim 10, wherein the lock claw section protrudes from the side surface of the housing perpendicular to a major surface of the housing.

12. A flat cable connector, comprising:

a housing having a top surface, a pair of opposite first side surfaces positioned adjacent the top surface and extending parallel across a width of the housing, a lock section disposed along each first side surface, each having a first protruding hook;

a contact located in the housing and having a portion protruding from the top surface; and a cover member having a planar surface, a pair of opposite first cover edges positioned adjacent to the planar surface and extending parallel across a width of the cover member, a locking protrusion piece positioned on each of the first cover edges and extending perpendicular to the planar surface, each locking protrusion piece having a first hook receiving opening that vertically receives the first protruding hook of the lock section when the housing is vertically snap-fitted to the cover member.

13. The flat cable connector of claim 12, wherein the housing further includes a pair of opposite second side surfaces positioned adjacent the top surface and first side surfaces, and extending parallel across a length of the housing.

14. The flat cable connector of claim 13, wherein each of the second side surfaces has an additional lock section disposed on each of the second side surfaces, each additional lock section having a second protruding hook.

15. The flat cable connector of claim 14, wherein the cover member further includes a pair of opposite second cover edges positioned adjacent to the planar surface and first cover edges, and extending parallel across a length of the cover member.

16. The flat cable connector of claim 15, wherein each of the second cover edges has an additional locking protrusion piece extending perpendicular to the planar surface, each additional locking piece having a second hook receiving opening that vertically receiving the second protruding hook of the additional lock section when the housing is vertically snap-fitted to the cover member.

* * * * *